US006158579A

United States Patent [19]

Rosenbaum

[11] Patent Number: 6,158,579

[45] Date of Patent: Dec. 12, 2000

[54] CONTAINER WITH POP-UP DISPLAY HEADER

[75] Inventor: John Rosenbaum, Indianapolis, Ind.

[73] Assignee: Inland Paperboard and Packaging, Inc., Indianapolis, Ind.

[21] Appl. No.: 09/258,454

[22] Filed: Feb. 26, 1999

Related U.S. Application Data

[60] Provisional application No. 60/076,025, Feb. 26, 1998.

[51] Int. Cl.[7] ..... B65D 5/66

[52] U.S. Cl. ..... 206/45.29; 206/767; 206/815; 229/240

[58] Field of Search ..... 206/45.28, 45.29, 206/45.3, 767, 768, 815; 229/162, 223, 227, 240

[56] References Cited

U.S. PATENT DOCUMENTS

| | | | |
|---|---|---|---|
| D. 118,010 | 12/1939 | Broderick | 206/45.29 |
| 1,472,953 | 11/1923 | Bamber | 206/45.29 |
| 1,616,708 | 2/1927 | Tanner | 206/45.29 |
| 2,178,730 | 11/1939 | Stein | 229/223 |
| 4,361,236 | 11/1982 | Lavery | 229/227 |
| 4,416,369 | 11/1983 | Burns | 206/45.29 |
| 4,860,886 | 8/1989 | Northrup et al. | 206/45.29 |
| 4,865,187 | 9/1989 | Zulauf et al. | 229/162 |
| 6,003,664 | 12/1999 | Dolan | 206/45.29 |

*Primary Examiner*—Jim Foster
*Attorney, Agent, or Firm*—Barnes & Thornburg

[57] ABSTRACT

A container having a body including a floor and a skirt coupled to the floor arranged to define a goods-storage region above the floor. The skirt including a rear side wall, left and right end walls coupled to the floor and arranged to lie in spaced-apart relation to position the rear side wall therebetween and a convertible section pivotably coupled to the rear side wall for movement between a closure position coupled to the left and right end walls to cover the goods-storage region and a display position uncoupled from the left and right end walls to uncover the goods-storage region, wherein the convertible section includes a top wall portion pivotably coupled to the rear side wall, a first frangible connector coupling the top wall portion to the left end wall, a second tangible connector coupling the top wall portion to the right end wall, a detachable portion pivotably coupled to the top wall portion, and a third frangible connector coupling the detachable portion to the skirt. The top wall portion including a rear top flap pivotably coupled to the top edge of the rear side wall and a front top flap having a front edge pivotably coupled to a top edge of the detachable portion and a rear edge disconnected from the rear top flap and positioned to lie alongside the rear top flap when the convertible section is in the closure position and to lie farther away from the rear top flap when the convertible section is in the display position.

47 Claims, 9 Drawing Sheets

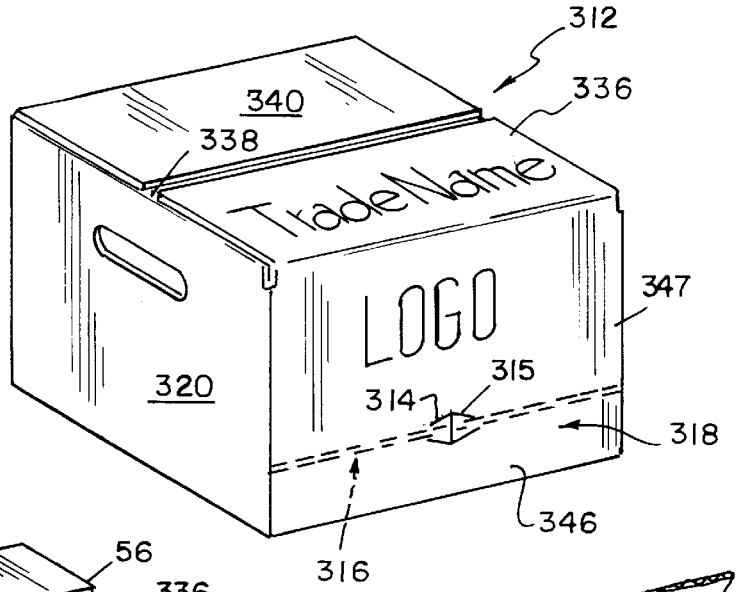
FIG. 21
FIG. 22
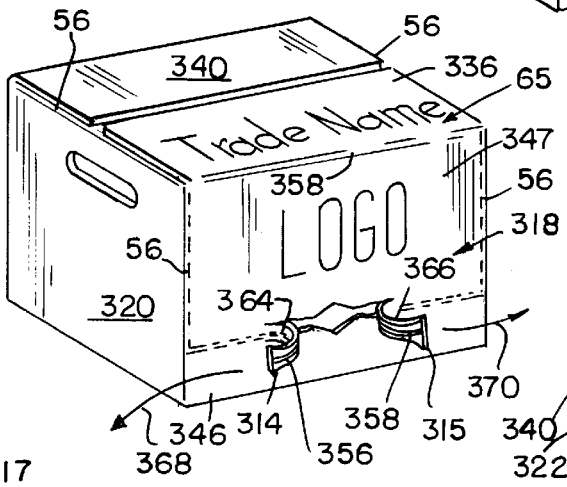
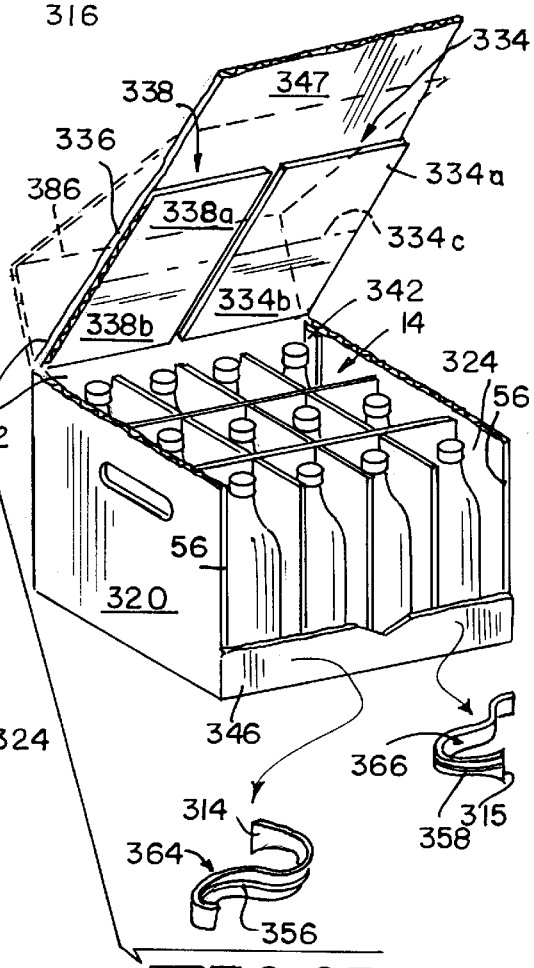
FIG. 23
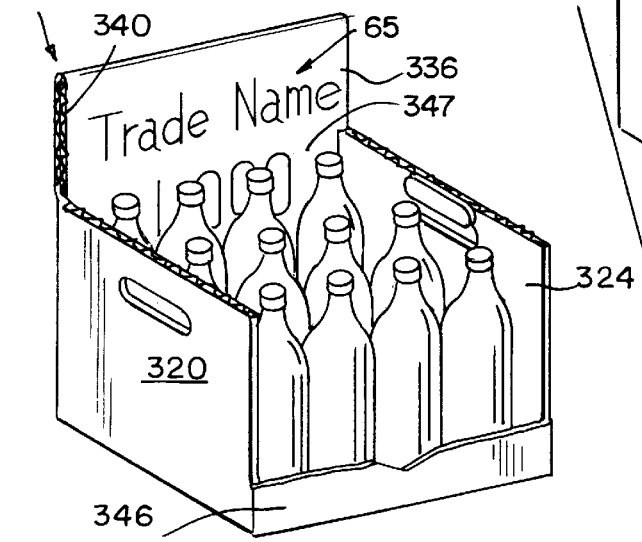
FIG. 24

CONTAINER WITH POP-UP DISPLAY HEADER

BACKGROUND AND SUMMARY OF THE INVENTION

This claims priority under 35 U.S.C. § 119(e) of Ser. No. 60/076,025, filed Feb. 26, 1998.

The present invention relates to containers, and particularly to container made of a corrugated material. More particularly, the present invention relates to a container that is convertible from a product-shipping case to a product-displaying case.

It is common to pack bottled goods in a shipping case made of corrugated material. A "case" of beer typically comprises four six-pack cartons of bottled beer stored in a corrugated box configured to be shipped from a bottler to a distributor and/or a retailer. Each six-pack includes a paperboard carton containing six bottles of beer.

In some cases, retailers remove the six-pack cartons of bottled goods from the corrugated shipping box for display and sale. However, in recent times, retailers desire to stock "opened" corrugated shipping boxes containing six-pack cartons of bottled goods on the floor in a retail store to enable customers to remove and purchase six-pack cartons stored in such on-floor corrugated boxes. These retailers would welcome a shipping case that was adapted to facilitate display of the goods contained therein in a retail store without first removing the goods from the shipping case.

According to the present invention, a container includes a floor, front and rear side walls, and left and right end walls, and a top wall portion adapted to be coupled to the side and end walls to cover an opening into an interior region formed in the container. The top wall portion and the front side wall cooperate to define a convertible section that is movable between a closure position covering the opening into the goods-storage region and a display position uncovering the opening enabling customers to remove goods stored in the interior region of the container.

Advertising material printed on parts of the top wall portion and front side wall is positioned to lie along an inner surface of the rear side wall and generally above goods stored in the interior region of the container after the convertible section has been moved to the display position to convey information about the goods stored in the container to consumers passing by the "opened" container on a sales floor.

In preferred embodiments, the convertible section includes four top flaps included in the top wall portion and a detachable portion included in the front side wall. Specifically, the top wall portion includes a rearward top flap pivotably coupled to the rear side wall, a forward top flap pivotably coupled to an upper edge of the detachable portion, and left and right flaps coupled to the rearward and forward flaps and configured to support the forward top flap of the top wall portion and the detachable portion of the front side wall so that the forward top flap and detachable portion can be moved easily relative to the rear side wall and left and right end walls as the convertible section is moved from the closure position to the display position. The front side wall also includes a fixed portion coupled to the floor and the left and right end walls.

Frangible connections are provided to retain the convertible section normally in the closure position yet allow a retailer to "open" the container and move the convertible section to the display position without removing goods from the interior region of the container. A first frangible connector couples the left top flap to the left end wall and a second frangible connector couples the right top flap to the right end wall. A third frangible connector couples the detachable portion to the fixed portion.

Openings are formed in the front side wall between the fixed and detachable portions to enable a retailer to reach therein, grip the detachable portion and then separate the detachable portion from the fixed portion by "breaking" the third frangible connector. The top closure portion can then be separated from the left and right end walls by "breaking" the first and second frangible connectors. The top closure portion can then be folded to present the advertising material on outer surfaces of the front top flap and detachable portion sot hat they face toward a consumer looking at the goods stored in the interior region of the container through the front opening formed in the front side wall and the top opening.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 21 is a view of a closed container made of the container blank shown in FIG. 20;

FIG. 22 is a view similar to FIG. 21 showing partial removal of two tear strips from the front side wall of the container;

FIG. 23 is a view similar to FIG. 22 showing two stages of movement of a pop-up display header comprising four top flaps and the detachable portion of the front side wall after removal of the left and right tear strips from the container; and FIG. 24 is a view similar to FIG. 23 showing the pop-up display header after it has been folded and moved to assume an upright position arranged to lie at the rear of the container and behind bottled goods stored in the container.

DETAILED DESCRIPTION OF THE DRAWINGS

Figure 1:
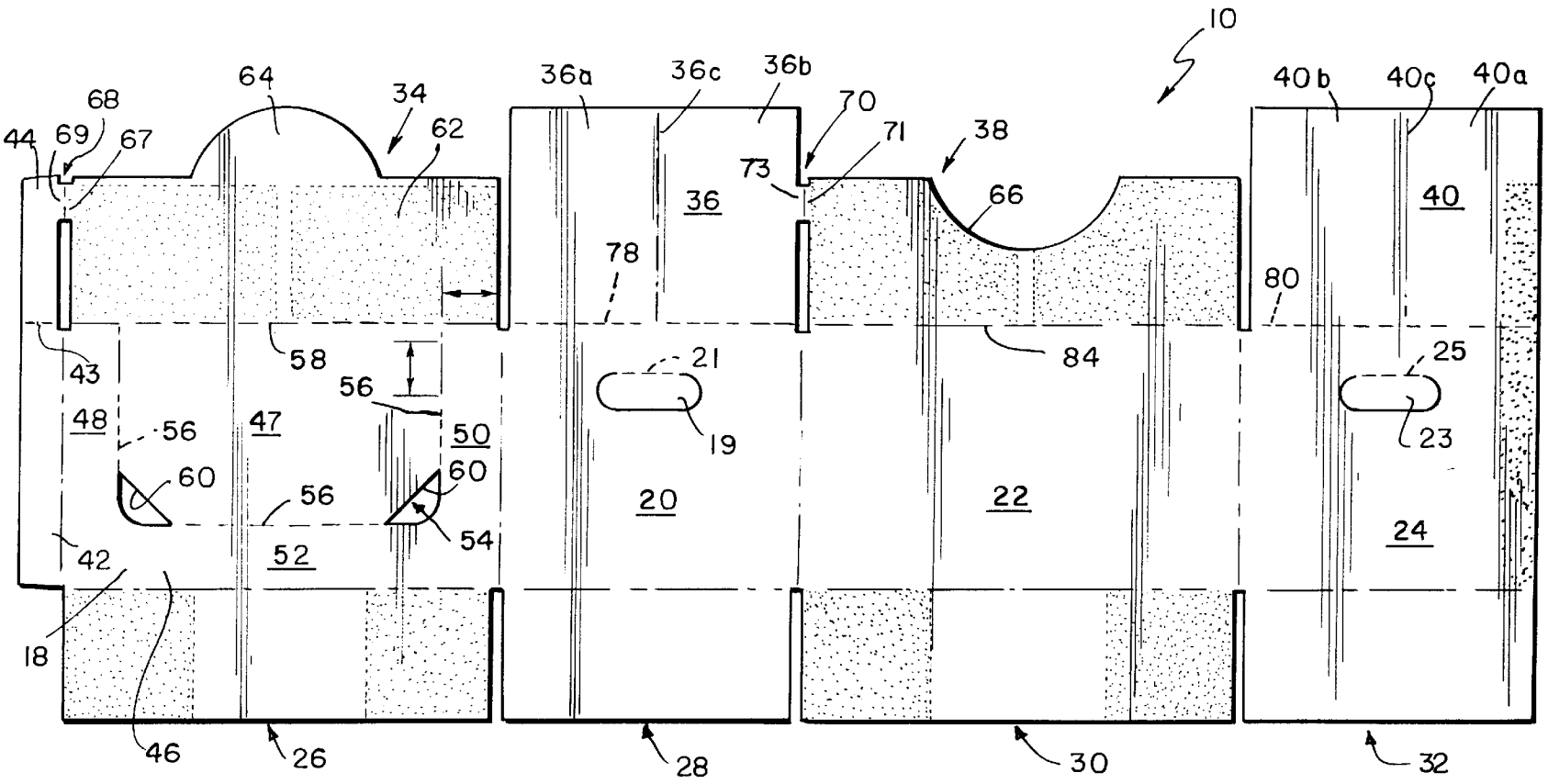
FIG. 1 is a plan view of a first container blank that can be assembled to produce a container with a pop-up display header in accordance with the present invention.

A blank 10 for use in making a paperboard container is shown in FIG. 1. Blank 10 can be manufactured and folded as shown in FIGS. 2–8 to form a container 12 shown in FIG. 9. Container 12 is configured to hold various bottled, canned, boxed, or packaged goods such as, for example, six-pack cartons of bottled beer 14.

Figure 10:
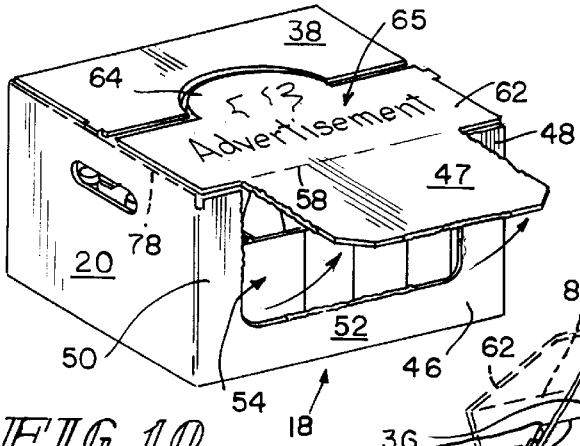
FIG. 10 is a view similar to FIG. 9 showing forward and outward swinging movement of the detachable portion after separation from a fixed portion of the front side wall of the container.
Figure 11:
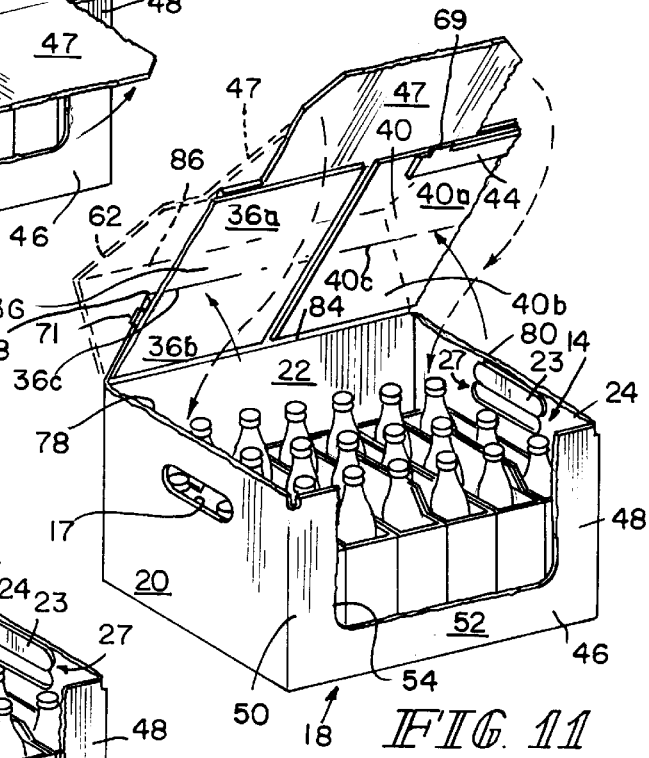
FIG. 11 is a view similar to FIG. 10 showing two stages of movement of a pop-up display header unit comprising the four top flaps and the detachable portion of the front side wall after separation of three of the four top flaps from the front side wall and two end side walls of the container and showing that the bottled goods remain stored in the container during such stages of movement.
Figure 12:
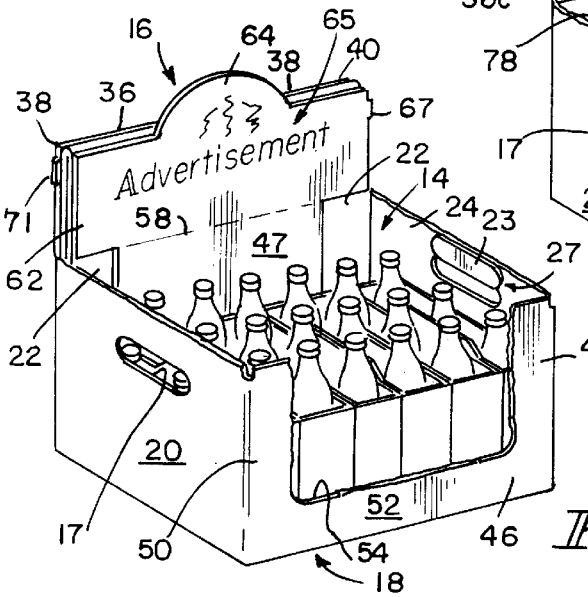
FIG. 12 is a view similar to FIG. 11 showing the pop-up display header unit after it has been folded and moved to assume an upright position arranged to lie at the rear of the container and behind the bottled goods stored in the container and to present the message-display surface included in the pop-up display header for easy viewing by a retail consumer passing by the opened container in a retail store.

After a filled container 12 has been shipped to a retail store, the retailer can "open" container 12 as shown in FIGS. 10–12 without removing any of the goods 14 stored in container 12 to provide a pop-up display header 16 positioned to lie behind the goods 14 stored in opened container 12. Advertising material 65 can be printed on the pop-up display header 16 as shown in FIG. 12 to convey information about the goods 14 stored in container 12 to a retail customer as the customer inspects goods 14 stored in the opened container 12 on the sales floor of a retail store.

Blank 10 includes a front side wall 18, a left end wall 20, a rear side wall 22, and a right end wall 24 as shown, for example, in FIG. 1. Blank 10 further includes a first bottom flap 26 appended to a bottom edge of front side wall 18, a second bottom flap 28 appended to a bottom edge of left end wall 20, a third bottom flap 30 appended to a bottom edge of rear side wall 22, and a fourth bottom flap 32 appended to a bottom edge of right end wall 24.

Blank 10 also includes four top flaps 34, 36, 38, and 40 and two side tabs 42 and 44 as also shown best in FIG. 1. Front top flap 34 is coupled to a top edge of front side wall 18, left top flap 36 is coupled to a top edge of left end wall 20 by a first frangible connector 78, rear top flap 38 is pivotably coupled to a top edge of rear side wall 22, and right top flap 40 is coupled to a top edge of right end wall 24 by a second frangible connector 80. Side tab 42 is coupled to side tab 44 along fold line 43 and to front side wall 18 as shown in FIG. 1. Left top flap 36 includes a forward section 36*a*, a rearward section 36*b*, and a fold line 36*c* between the forward and rearward sections 36*a* and 36*b*. Right top flap 40 includes a forward section 40*a*, a rearward section 40*b*, and a fold line 40*c* between the forward and rearward sections 40*a* and 40*b*.

Blank 10 is made of a paperboard such a corrugated material and is die-cut or otherwise formed to have the configuration shown in FIG. 1. It is within the scope of this disclosure to vary the size and shape of the walls, flaps, and tabs of blank 10 and any blank disclosed herein to produce a rectangular, square, or other shape container of any suitable length, width, and height dimension.

Left end wall 20 includes a hand-grip portion 19 that can be folded along fold line 21 to form an open hand-receiving slot 17 shown, for example, in FIGS. 5–12. Right end wall 24 includes a hand-grip portion 23 that can be folded along fold line 25 to form an opened hand-receiving slot 27 shown, for example, in FIGS. 11 and 12.

Figure 9:
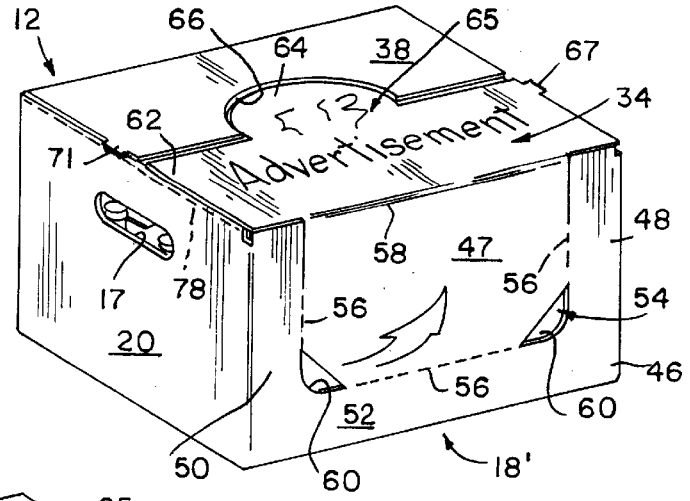
FIG. 9 is a view similar to FIG. 8 of a closed container in accordance with the present invention showing two finger-receiving openings formed in the front side wall of the container to facilitate later removal of the detachable portion as shown, for example, in FIG. 10.

Front side wall 18 includes a fixed portion 46 and a detachable portion 47 as shown, for example, in FIGS. 1, 9, and 10. Fixed portion 46 is somewhat U-shaped and resembles a frame and includes a first border panel 48 appended to side tab 42, a second border panel 50 appended to left end wall 20, and a bottom border panel 52 appended to first bottom flap 26 and arranged to interconnect the lower ends of first and second border panels 48, 50. Detachable portion 47 is sized to fit in a window-like opening 54 (see FIGS. 1, 9, and 10) defined by first, bottom, and second border panels 48, 52, 50 (respectively), as shown, for example, in FIGS. 1 and 9, until detachable portion 47 is separated from U-shaped fixed portion 46 during opening of container 12 and formation of pop-up display header 16 as shown, for example, in FIGS. 9–12.

Detachable portion 47 is coupled to U-shaped fixed portion 46 by a third frangible connector comprising three perforated tear lines 56 and to front top flap 34 along fold line 58 as shown, for example, in FIGS. 1 and 9. Front side wall 18 is also formed to include two finger-receiving openings 60 along a border line between fixed portion 46 and detachable portion 47. One opening 60 is formed at one corner of U-shaped fixed portion 46 and another opening 60 is formed at another corner of fixed portion 46. Openings 60 are sized to receive one or more fingers of a retail store clerk enabling the clerk to reach therein, grip detachable portion 47, and separate detachable portion 47 from fixed portion 46 as shown in FIGS. 9 and 10 by tearing front side wall 18 in a controlled manner along perforated tear lines 56.

As shown in FIG. 1, front top flap 34 is formed to include a rectangular section 62 and a semicircular section 64 appended to a top edge of the rectangular section 62. Semicircular section 64 is sized to fit in a semicircular cutout 66 formed in rear top flap 38 when container 12 is assembled as shown, for example, in FIG. 9. It is within the scope of this disclosure to provide section 64 and cutout 66 with any suitable shape.

Side tab 44 is coupled to one end of rectangular section 62 by a first connector link 68 as shown in FIG. 1. First connector link 68 includes a flange 67 appended to rectangular section 62, a flange 69 appended to tab 44, and a score line between flanges 67 and 69. Left top flap 36 is coupled to one end of rear top flap 38 by a second connector link 70 as also shown in FIG. 1. Second connector link 70 includes a flange 71 appended to rear top flap 38, a flange 73 appended to left top flap 36, and a score line between flanges 71 and 73. These connector links 68, 70 function to maintain top flaps 34, 36, 38, and 40 in proper positions during loading of bottled goods 14 or other goods into an opened container 12 just before the closure step shown in FIG. 7.

Figure 2:
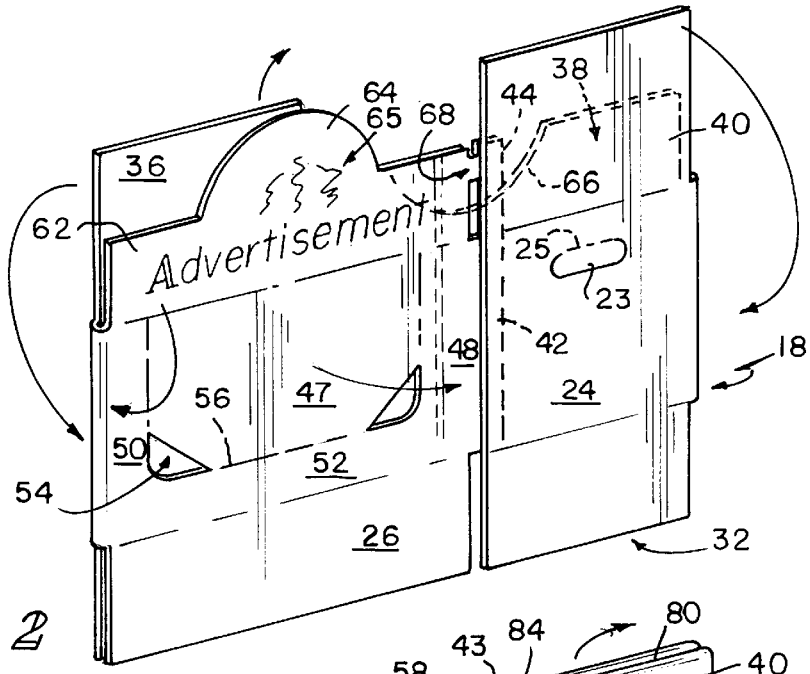
FIG. 2 is a perspective view of the container blank of FIG. 1 after it has been folded and coupled during an initial container formation stage.
Figure 3:
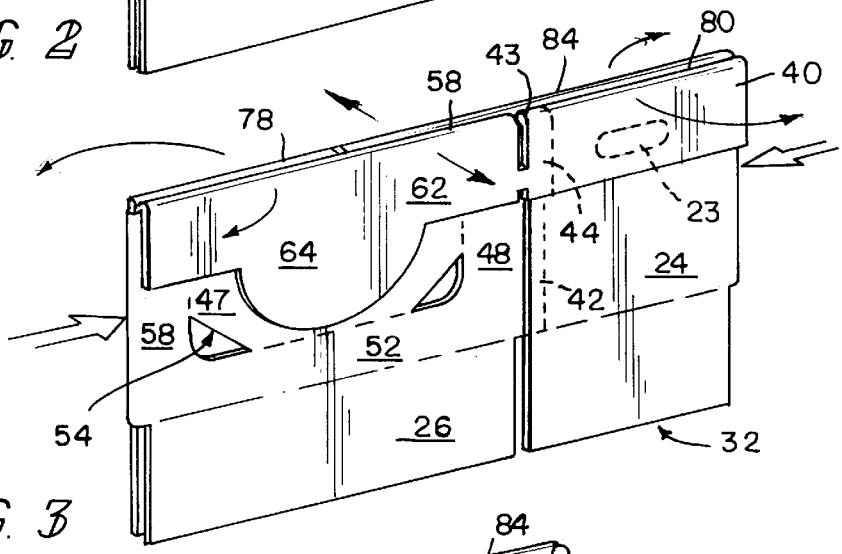
FIG. 3 is a view similar to FIG. 2 after the four top flaps included in the container blank have been folded during a subsequent container formation stage.
Figure 4:
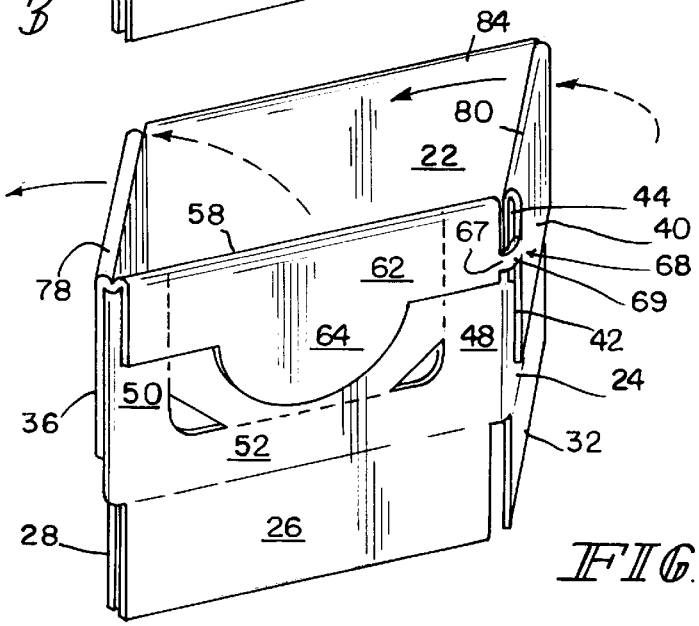
FIG. 4 is a view similar to FIGS. 2 and 3 showing the container blank of FIG. 3 as it is being "opened"
Figure 5:
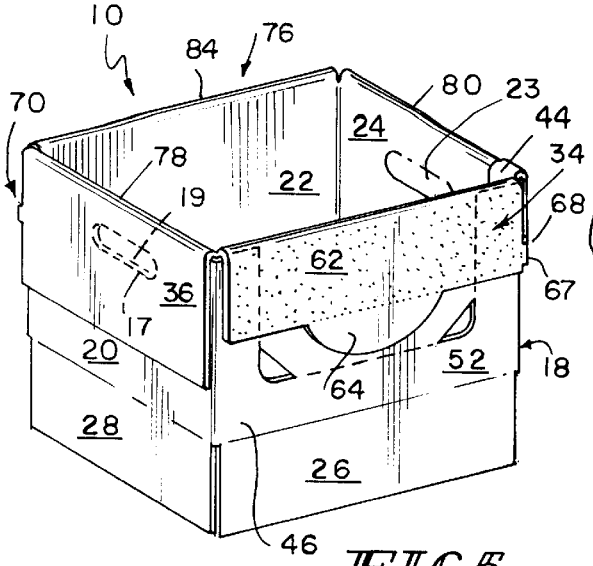
FIG. 5 is a "top" perspective view of the container blank of FIG. 1 after it has been folded and two portions of the container blank have been coupled to one another to produce a container sleeve during a first stage of container assembly.

Blank 10 is assembled as shown, for example, in FIGS. 2–9. The "sleeve" 76 shown in FIG. 5 is formed by coupling side tab 42 to right end wall 24 and coupling side tab 44 to right top flap 40 as shown in FIG. 2 using, for example, glue or other adhesive (represented by stippled dot patterns in FIGS. 1 and 5–9) and then folding blank 10 as shown in FIGS. 3 and 4. Product-display art 65 printed on the exterior side of rectangular and semicircular sections 62, 64 of front top flap 34 is visible at the "FIG. 2" stage of assembly and will also be visible when container 12 is closed as shown in FIG. 9 and when the top flaps 34, 36, 38, and 40 are moved to open container 12 and form pop-up display header 16 as shown in FIGS. 11 and 12.

Figure 6:
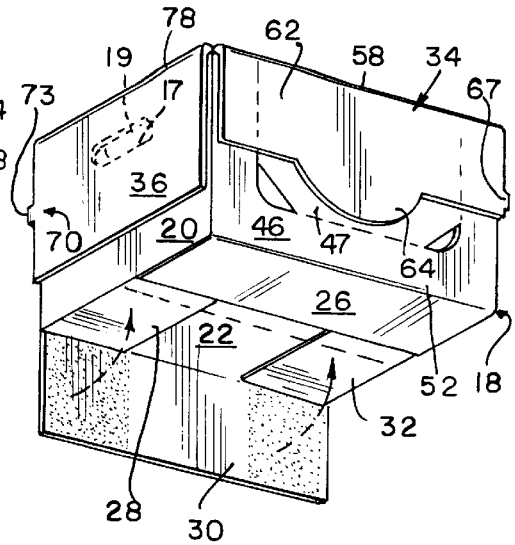
FIG. 6 is a "bottom" perspective view showing folding of bottom flaps included in the container blank to form a bottom wall of a container in accordance with the present invention.
Figure 7:
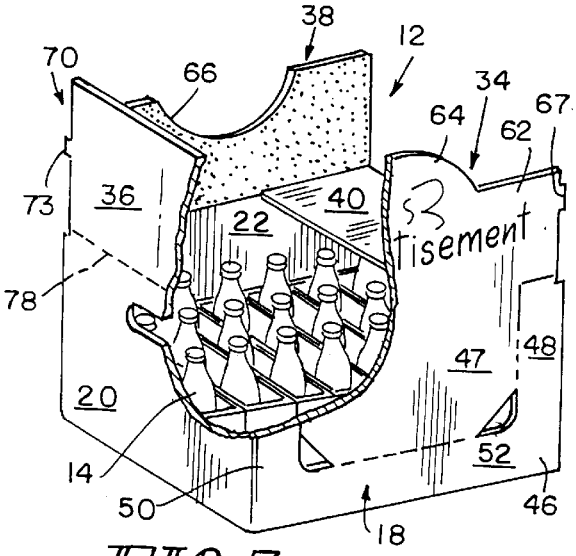
FIG. 7 is a view similar to FIG. 5, with portions broken away, showing bottled goods packed in the container of FIG. 3 prior to closure of four top flaps included in the container blank.

Once the sleeve 76 shown in FIG. 5 is assembled, bottom flaps 28 and 32 are folded and bottom flaps 26 and 30 are coupled to bottom flaps 28 and 32 to form a bottom wall or floor of container 12 in the manner shown, for example, in FIG. 6. Herein, glue or other suitable adhesive is represented by stippled dot patterns. Once the bottom wall is formed, container 12 can be filled with bottled goods 14 or any other goods as shown, for example, in FIG. 17. First and second connector links 68, 70 function, in part, to hold top flaps 34, 36, 38, and 40 in a fully opened position to facilitate top-loading of goods 14 initially into opened container 12. First and second connector links 68, 70 will be severed along the score lines provided therein during closure of top flaps 34, 36, 38, and 40 as shown, for example, in FIGS. 7 and 8.

Figure 8:
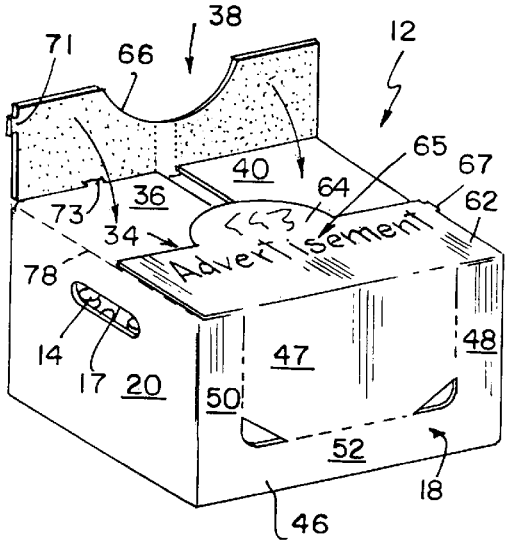
FIG. 8 is a view similar to FIG. 7 showing closure of three of the four top flaps wherein one of the closed top flaps includes product-display art printed thereon to define a message-display surface and a detachable portion of the front side wall of the container is appended to the top flap including the message-display surface.

As shown in FIGS. 8 and 9, semicircular section 64 included in front top flap 34 nests in semicircular cutout 66 formed in rear top flap 38 following closure of all four top flaps 34, 36, 38, and 40. Advertising material 65 printed, for example, on exterior surfaces of semicircular section 64 and rectangular section 62 of front top flap 34 is visible both when container 12 is closed as shown in FIG. 6 and after pop-up display header 16 has been erected as shown in FIG. 12.

Container 12 is opened and pop-up display header 16 is erected as shown, for example, in sequence in FIGS. 9–12. First, detachable portion 47 is separated from fixed portion 46 along perforated tear lines 56 and folded relative to front top flap 34 along fold line 58 as shown in FIGS. 9 and 10. Second, top wall 34, 36, 38, 40 of container 12 is separated from left end wall 20 and right end wall 24 along perforated tear lines 78, 80 (see FIGS. 1 and 11) and folded in directions 82 relative to rear side wall 22 along fold line 84. Tear tape formed to include a pull string can also be used along lines 78, 80 instead of perforations (see FIGS. 17-20). Third, as shown in phantom lines in FIG. 11, the top wall comprising top flaps 34, 36, 38, and 40 is folded along fold line 86 to cause the left and right top flaps to be "folded in half" so that front top flap 34 and rear top flap 38 lie in spaced-apart parallel relation to one another and the now-separated detachable flap 47 lies in spaced-apart parallel relation to rear side wall 22 as shown, for example, in FIG. 12.

As shown in FIG. 12, bottled goods 14 are visible through the "opened" window 54 formed in front side wall 18 and removable from container 12 through a top opening created during separation and folding of the top flaps 34, 36, 38, and 40 from the rest of container 12 to create pop-up display header 16. Also, advertising material 65 on pop-up display header 16 is visible to customers inspecting bottled goods stored in opened container 12 as shown in FIG. 12. None of bottled goods 14 had to be removed from container 12 during opening of container 12 and forming the pop-up display header 16. As shown in FIG. 12, rear top flap 38 is aligned in coplanar relation to rear side wall 22 and front top flap 34 and detachable portion 47 are aligned in coplanar relation and adjacent to rear side wall 22 upon movement of top wall portion 34, 36, 38, 40 to form pop-up display header 16.

Figures 13, 14:
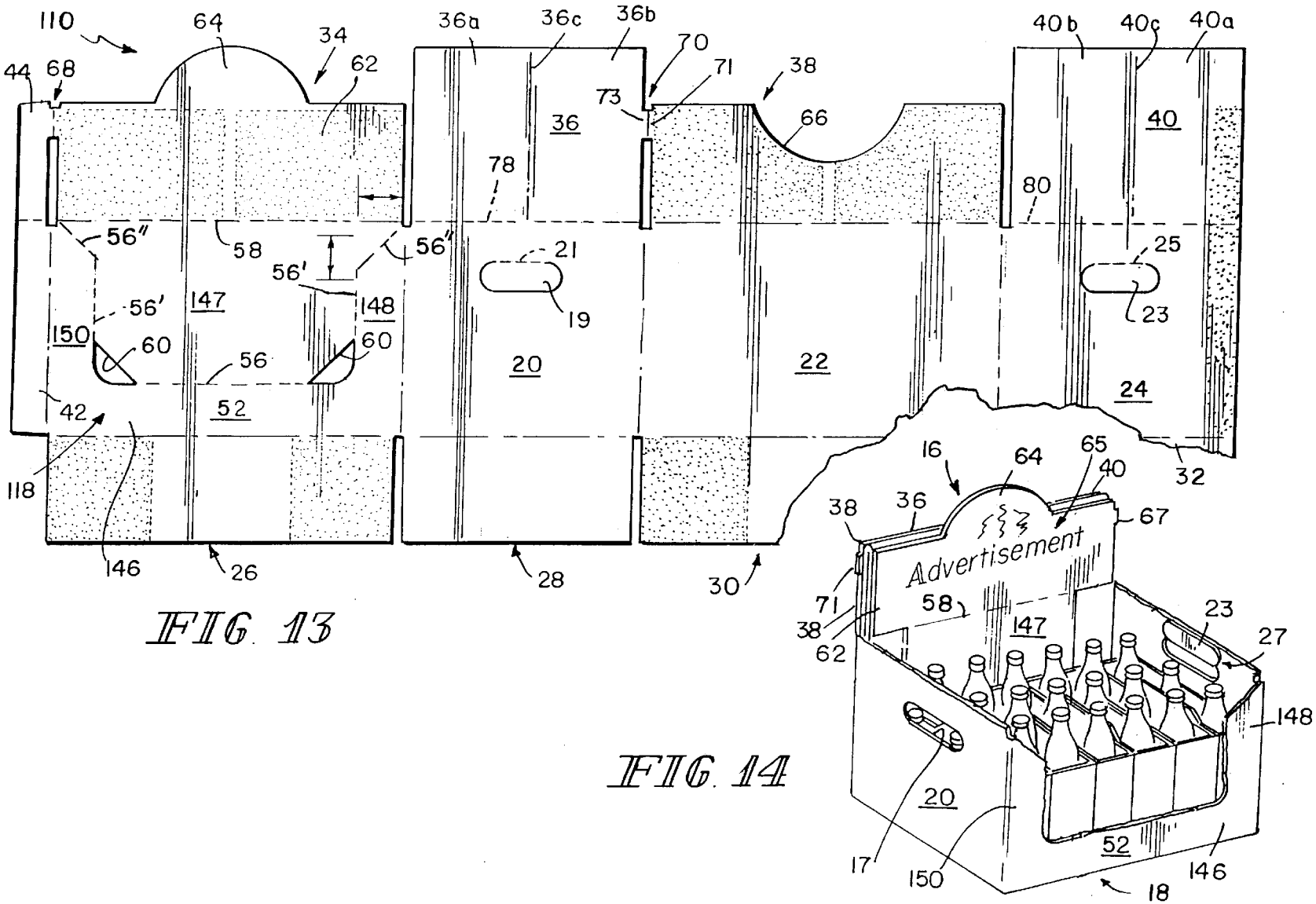
FIG. 13 is a plan view of a second container blank in accordance with the present invention showing an alternative design of the detachable portion provided in the front side wall of the container.
FIG. 14 is a perspective view of an opened container with a pop-up header made using the container blank shown in FIG. 13.

In another embodiment shown in FIGS. 13 and 14, container blank 110 includes a modified front side wall 118. All other aspects of blank 110 are the same as blank 10 shown in FIG. 1. Modified front side wall 118 includes two vertical perforated tear lines 56' and two slanted perforated tear lines 56". The arrangement of these tear lines 56' and 56" change the shapes of fixed portion 146 and detachable portion 147 somewhat as compared to fixed portion 46 and detachable portion 147.

Figure 15:
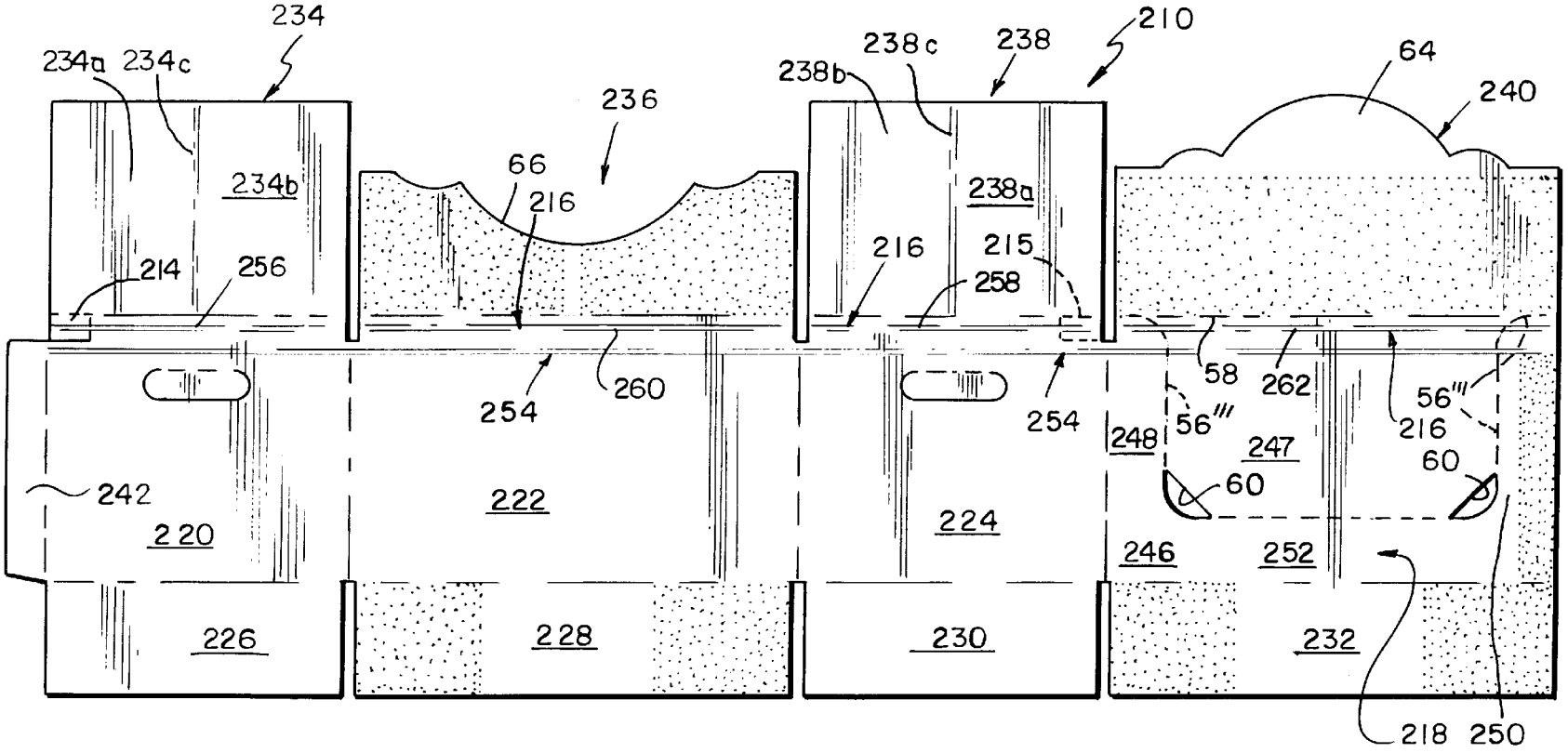
FIG. 15 is a plan view of a third container blank in accordance with the present invention showing a strip of tear tape that is laid down on the container blank and coupled to two pull tabs that are formed in the container blank and used as shown in FIGS. 17 and 18 to separate a top wall of a container made of the container blank from two end walls of the container.

A blank 210 for use in making a paperboard container is shown in FIG. 15. Blank 210 can be manufactured and folded (in a manner similar to the manner shown in FIGS. 2–8) to form a container 212 shown in FIG. 16. Blank 210 is formed to include two pull tabs 214, 215 and a strip of tear tape 216 is adhered to the two pull tabs 214, 215 and other portions of inner walls of blank 210 as shown in FIG. 15.

Figure 17:
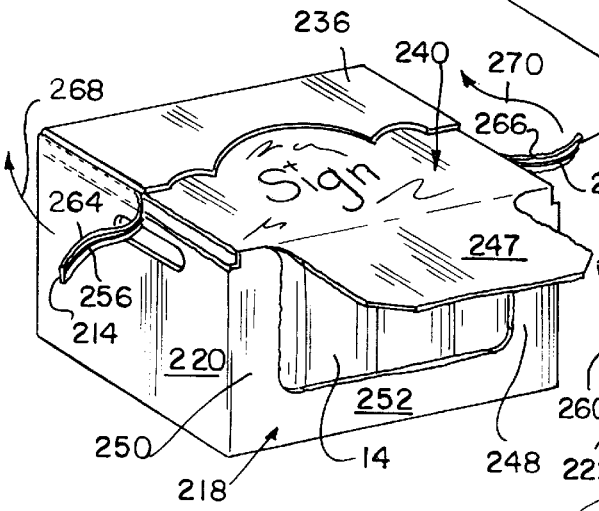
FIG. 17 is a view similar to FIG. 16 showing forward and outward movement of a detachable portion of the front side wall of the container and partial removal of two tear strips from the container, one of the tear strips lying along the upper edge of the left end wall of the container and including a left pull tab and a portion of the tear tape shown in FIG. 16 and the other of the tear strips lying along the upper edge of the right end wall of the container and including a right pull tab and another portion of the tear tape shown in FIG. 15.
Figure 18:
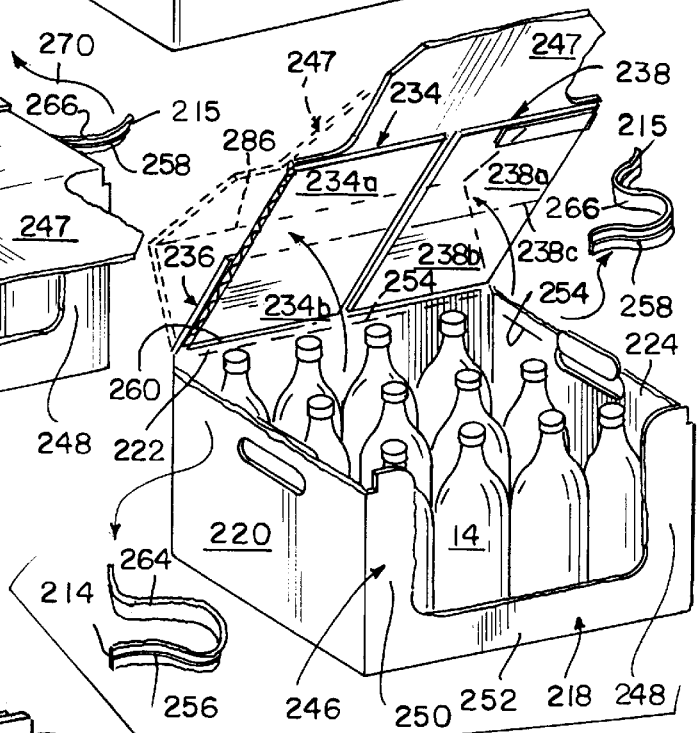
FIG. 18 is a view similar to FIG. 17 showing two stages of movement of a pop-up display header comprising four top flaps and the detachable portion of the front side wall after removal of the left and right tear strips from the container.
Figure 19:
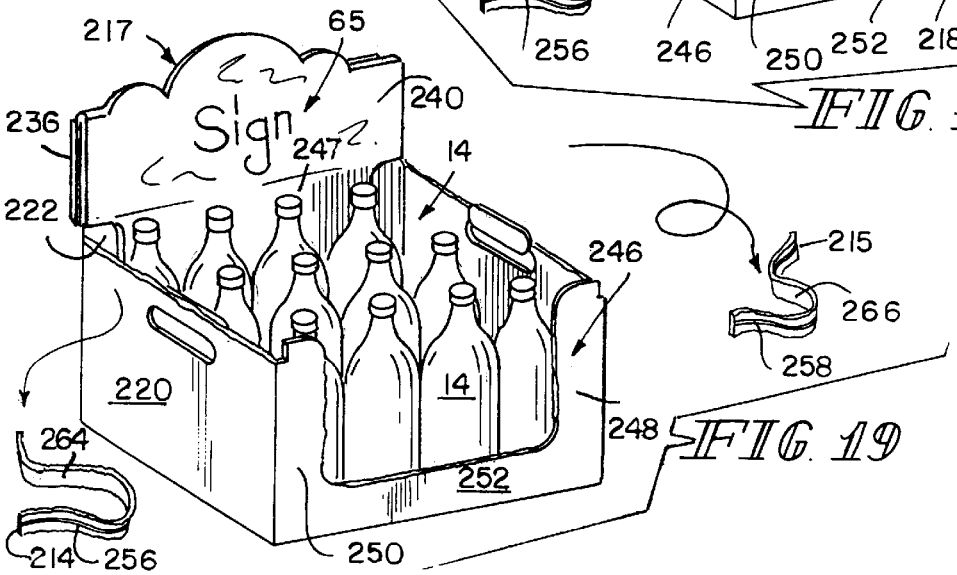
FIG. 19 is a view similar to FIG. 18 showing the pop-up display header after it has been folded and moved to assume an upright position arranged to lie at the rear of the container and behind bottled goods stored in the container.

After a filled container 212 has been shipped to a retail store, the retailer can open container 212 using pull tabs 214, 215 and portions of tear tape 216 coupled to pull tabs 214, 215 as shown in FIGS. 16–19. A pop-up display header 217 (similar to pop-up display header 16 shown in FIG. 12) can be positioned to lie behind the goods 14 stored in the open container 212 without removing any of the goods 14 stored in container 212. Advertising material 65 can be printed on the pop-up display header 217 as shown in FIG. 19 to convey information about the goods to a retail customer as the customer inspects goods 14 stored in the opened container 212 on the sales floor of a retail store.

Blank 210 includes front side wall 218, a left end wall 220, a rear side wall 222, and a right end wall 224 as shown, for example, in FIG. 15. Blank 210 further includes a first bottom flap 226 appended to a bottom edge of left end wall 220, a second bottom flap 228 appended to a bottom edge of rear side wall 222, a third bottom flap 330 appended to a bottom edge of right end wall 224, and a fourth bottom flap 332 appended to a bottom edge of front side wall 218.

Blank 210 also includes four top flaps 234, 236, 238, and 240 and one side tab 242 as shown, for example, in FIG. 15. Left top flap 234 is coupled to a top edge of left end wall 220, rear top flap 236 is pivotably coupled to a top edge of rear side wall 222, right top flap 238 is coupled to a top edge of right end wall 224, and front top flap 240 is appended to a top edge of front side wall 218. Side tab 242 is appended to left end wall 220 as shown in FIG. 15. Left top flap 234 includes a forward section 234*a*, a rearward section 234*b*, and a fold line between forward and rearward sections 234*a* and 234*b*. Right top flap 238 includes a forward section 238*a*, a rearward section 238*b*, and a fold line between forward and rearward sections 234*a* and 234*b*. First top flap 234 is appended to a top edge of left end wall 220, second top flap 236 is appended to a top edge of rear side wall 222, third top flap 238 is appended to a top edge of right end wall 224, and fourth top flap 240 is appended to a top edge of front side wall 218. Side tab 242 is appended to left end wall 220 as shown in FIG. 15.

Figure 16:
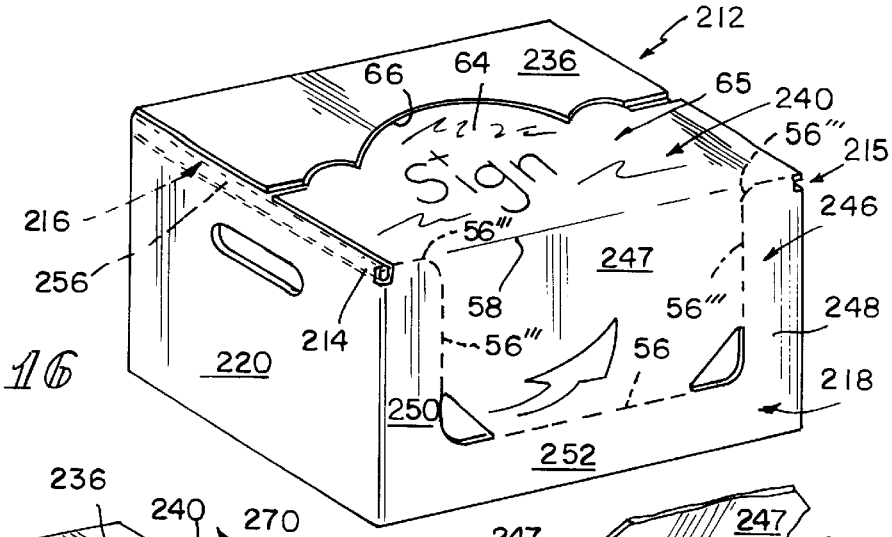
FIG. 16 is a view of a closed container made of the container blank shown in FIG. 15.

Front side wall 218 includes a fixed portion 246 and a detachable portion 247 as shown, for example, in FIGS. 15–17. Fixed portion 246 is somewhat U-shaped and includes a first border panel 248 appended to right end wall 224, a second border panel 250, and a bottom border panel 252 appended to bottom flap 232 and arranged to interconnect the lower ends of first and second border panels 248, 250. Detachable portion 247 is similar to detachable portion 47 shown in FIG. 1 and is detachable from fixed portion 246 in a similar manner.

A strip of tear tape 216 is applied to inner walls of blank 210 and arranged to extend along an uppermost portion of walls 220, 222, 224, and 218 as shown in FIG. 15. A strip of reinforced tape 254 is also applied to blank 210 and arranged to extend across walls 220, 222, 224, and 218 and lie in spaced-apart parallel relation to and below tear tape strip 216 as shown in FIG. 15.

During blank manufacture, a tear tape strip 216 is applied to a paperboard material and that material is die-cut to form blank 210 and sever tear tape strip 216 to establish a first tear strip 256 coupled to left pull tab 214 and arranged to extend along an upper edge of left end wall 220 to establish a first frangible connector configured to couple left top flap 234 to left end wall 220 and a second tear strip 258 coupled to right pull tab 215 and arranged to extend along an upper edge of right end wall 224 as shown in FIG. 15 to establish a second frangible connector configured to couple right top flap 238 to right end wall 224. One portion 260 of tear tape strip 216 on rear side wall 222 and another portion 262 of tear tape strip 216 on front side wall 218 are not used to facilitate "opening" of the closed container 212.

Container 212 is opened and pop-up display header 217 is erected as shown, for example, in sequence in FIGS. 16–19. First, detachable portion 247 is separated from fixed portion 246 along perforated tear lines 56, 56''' and folded relative to fourth top flap 240 along fold line 58 as shown in FIGS. 16 and 17.

Second, top wall 234, 236, 238, 240 of container 212 is separated from left end wall 220 using left pull tab 214 and tear strip 256 to remove an elongated section 264 of container material from left end wall 220 adjacent to left top flap 234 and from right end wall 224 using right pull tab 215 and tear strip 258 to remove an elongated section 266 of container material from right end wall 224 adjacent to right top flap 238. As shown in FIG. 17, left pull tab 214 is moved in direction 268 to initiate removal of the left-side material section 264 that is adhered to tear strip 256 and right pull tab 215 and moved in direction 270 to initiate removal of the right-side material section 266 that is adhered to tear strip 258.

Third, as shown in FIG. 18, the top wall portion comprising top flaps 234, 236, 238, and 240 is folded along fold line 286 established by fold lines 234*c* and 238*c*. This folding causes the left and right top flaps 234, 238 to be "folded in half" so that the rear top flap 236 and front top flap 240 lie in spaced-apart relation to one another and the now-separated detachable flap 247 lies in spaced-apart relation to rear side wall 222 as shown, for example, in FIG. 19.

Figure 20:
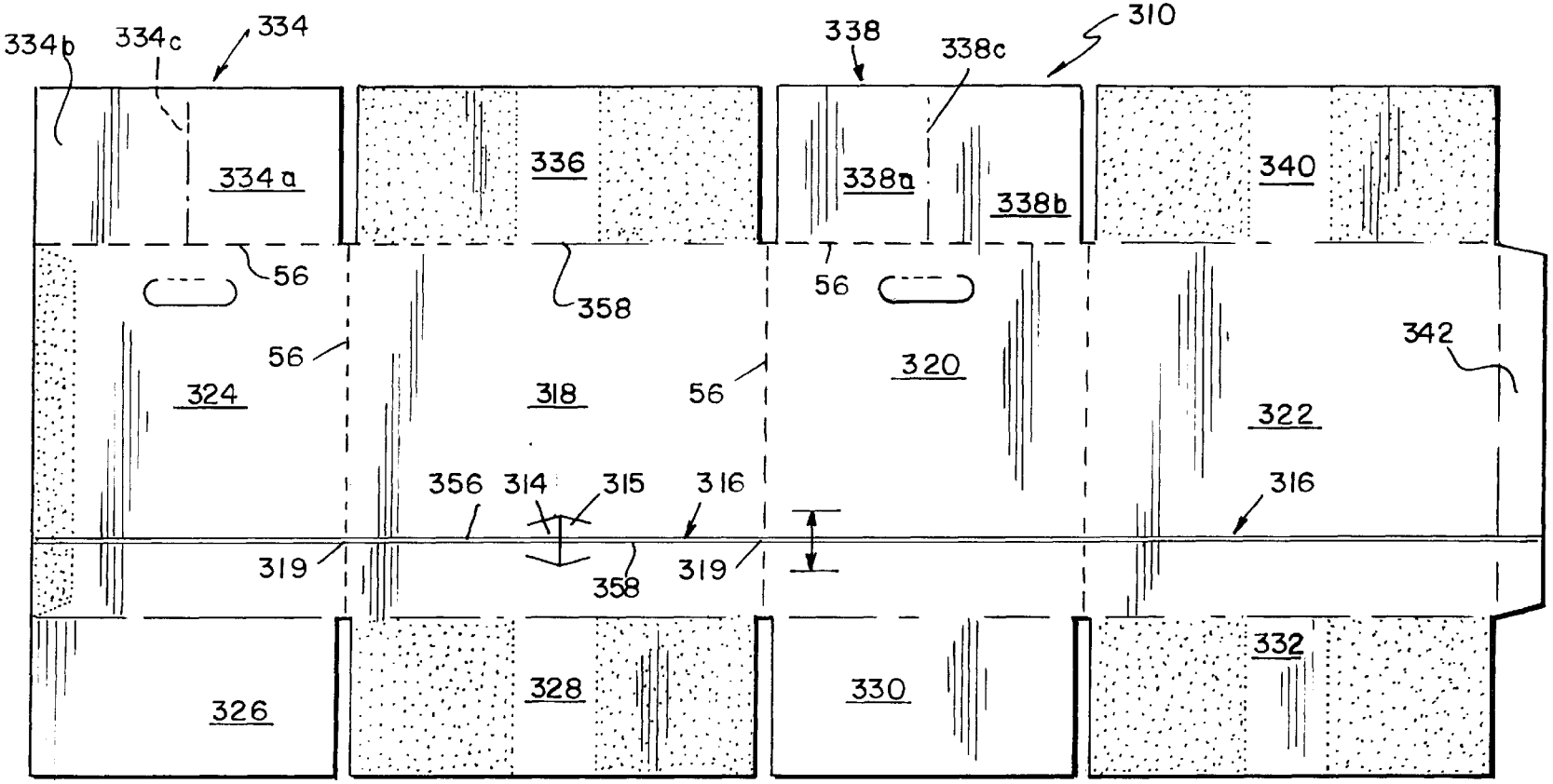
FIG. 20 is a plan view of a fourth container blank in accordance with the present invention showing the "outside" walls of the container blank and showing (in phantom) a strip of tear tape adhered to "inner" walls of the container blank and coupled to two side-by-side pull tabs formed in the "front side wall" of the container blank.

A blank 310 is shown in FIG. 20 for use in making a container 312 shown in FIG. 21. Blank 310 is formed to include two pull tabs 314, 315 and a strip of tear tape 316 is adhered to the two pull tabs 314, 315 and other portions of inner walls of blank 310 as shown in FIG. 20.

After a filled container 312 has been shipped to a retail store, the retailer can open container 312 using pull tabs 314, 315 and portions of tear tape 316 coupled to pull tabs 314, 315 as shown in FIGS. 21–24. A pop-up display header 317 can be positioned to lie behind the goods 14 stored in the opened container 312 without removing any of the goods 14 stored in container 312. Advertising material 65 can be printed on the pop-up display header 317 as shown in FIG. 24 to convey information about the goos to a retail customer as the customer inspects goods 14 stored in the opened container 312 on the sales floor of a retail store.

Blank 310 includes front side wall 318, a left end wall 320, a rear side wall 322, and a right end wall 324 as shown in FIG. 20. Blank 310 further includes a first bottom flap 326 appended to a bottom edge of right end wall 324, a second bottom flap 328 appended to a bottom edge of front side wall 318, a third bottom flap 330 appended to a bottom edge of left end wall 320, and a fourth bottom flap 332 appended to a bottom edge of rear side wall 322.

Blank 310 also includes four top flaps 334, 336, 338, and 340 and one side tab 342 as shown, for example, in FIG. 20. Right top flap 334 is coupled to a top edge of right end wall 324 by one frangible connector 56, front top flap 336 is coupled to a top edge of front side wall 318, left top flap 338 is coupled to a top edge of left end wall 320 by another frangible connector 56, and rear top flap 340 is pivotably coupled to a top edge of rear side wall 322. Side tab 342 is appended to rear side wall 322 and a portion of fourth bottom flap 332 as shown in FIG. 20. Left top flap 338 includes a forward section 338*a*, a rearward section 338*b*, and a fold line 338*c* between the forward and rearward sections 338*a* and 338*b*. Right top flap 334 includes a forward section 334*a*, a rearward section 334*b*, and a fold line 334*c* between the forward and rearward sections 334*a* and 334*b*.

Front side wall 218 includes a fixed portion 346 and a detachable portion 347 as shown, for example, in FIGS.

20–22. Fixed potion 346 is elongated and appended to an upper edge of second bottom flap 328 as shown in FIG. 20. Detachable portion 347 is positioned to lie between fixed portion 346 and second top flap 336 and also between left and right end walls 320, 324 as shown in FIG. 20.

Blank 310 is formed to facilitate separation of detachable portion 347 from fixed portion 346 and from left and right end walls 320, 324. Blank 310 is formed to include perforated or cut/score tear lines 56 or other suitable separation means between front side wall 318 and each of left and right end walls 320, 324, between left end wall 320 and third top flap 338, and between right end wall 324 and first top flap 334 as shown best in FIGS. 20 and 22.

A strip of tear tape 316 is applied to inner walls of blank 310 and arranged to extend along a horizontal line on walls 324, 318, 320, 322 as shown in FIG. 20 to define an upper edge of fixed portion 346 and a lower edge of detachable portion 347 in front side wall 318. It is within the scope of this disclosure to position tear tape 316 substantially along the line separating front side wall 318 and second bottom flap 328. During blank manufacture, tear tape strip 316 is severed at locations 319 as blank 310 is die-cut to establish first and second tear strips 356, 358. First tear strip 356 is coupled to left pull tab 314 and arranged to extend along a line partitioning the "left sides" of the fixed and detachable portions 346, 347 to a first of the cut lines 319. Second tear strip is coupled to right pull tab 315 and arranged to extend along a line partitioning the "right sides" of the fixed and detachable portions 346, 347 to a second of the cut lines 319. Portions of tear tape 316 on right end wall 324, left end wall 320, rear side wall 322, and side tab 342 are not used to facilitate "opening" of the closed container 312.

Container 312 is opened and pop-up display header 317 is erected as shown, for example, in sequence in FIGS. 21–24. First, left pull tab 314 is moved in direction 368 as shown in FIG. 22 to pull first tear strip 356 in that same direction so as to remove an elongated section 364 of container material coupled to first tear strip 356 from the "left side" of front side wall 318. Right pull tab 315 is moved in direction 370 as also shown in FIG. 22 to pull second tear strip 358 in that same direction so as to remove an elongated section 366 of container material coupled to second tear strip 358 from the "right side" of front side wall 318.

Second, detachable portion 347 is separated from left and right end walls 320, 324 along perforated tear lines 56. Detachable portion 347 is folded along fold line 358 during such separation. The vertical tear lines 56 and the tear strips 356, 358 cooperate to define a frangible connector configured to retain detachable portion 318 in its normal closed position as shown, for example, in FIGS. 20 and 21.

Third, as shown in FIG. 23, the top wall comprising top flaps 334, 336, 338, and 340 is folded along fold line 386. This folding causes the first and third top flaps 334, 338 to be "folded in half" along fold lines 334*c*, 338*c* so that the second top flap 336 and fourth top flap 340 lie in spaced-apart relation to one another and the now-separated detachable flap 347 lies in spaced-apart relation to rear side wall as shown, for example, in FIG. 24.

Although the invention has been described in detail with reference to certain preferred embodiments, variations and modifications exist within the scope and spirit of the invention as described and defined in the following claims.

What is claimed is:

1. A container comprising a body including a floor and a skirt coupled to the floor and arranged to define a goods-storage region above the floor, the skirt including a rear side wall coupled to the floor and left and right end walls coupled to the floor and arranged to lie in spaced-apart relation to position the rear side wall therebetween, and a convertible section pivotably coupled to the rear side wall for movement between a closure position coupled to the left and right end walls to cover the goods-storage region and a display position uncoupled from the left and right end walls and arranged to uncover the goods-storage region, the convertible section including a top wall portion pivotably coupled to the rear side wall, a first frangible connector coupling the top wall portion to the left end wall, a second frangible connector coupling the top wall portion to the right end wall, a detachable portion pivotably coupled to the top wall portion, and a third frangible connector coupling the detachable portion to the skirts the top wall portion including a rear top flap pivotably coupled to a top edge of the rear side wall and a front top flap having a front edge pivotably coupled to a top edge of the detachable portion and a rear edge disconnected from the rear top flap and positioned to lie alongside the rear top flap when the convertible section is in the closure position and to lie farther away from the rear top flap when the convertible section is in the display position.

2. The container of claim 1, wherein the skirt includes a front side wall coupled to the floor to lie opposite to the rear side wall and arranged to lie between the left and right end walls, the front side wall includes the detachable portion and a fixed portion coupled to the detachable portion by the third frangible connector and coupled to the floor.

3. The container of claim 2, wherein the fixed portion is U-shaped and has a first outer edge coupled to the right end wall, a second outer edge coupled to the left end wall, and a third outer edge coupled to the floor.

4. The container of claim 3, wherein the fixed portion includes a first border panel including the first outer edge, a second border panel including the second outer edge, and a bottom border panel interconnecting the first and second border panel and including the third outer edge, the first, second, and bottom border panels cooperate to define a rectangular opening, the detachable portion is positioned to lie in the rectangular opening, and the third frangible connector couples the detachable portion to each of the first, second, and bottom border panels to retain the detachable portion in the rectangular opening defined by the fixed portion until the convertible section is moved to the display position.

5. The container of claim 2, wherein the third frangible connector includes first and second tear lines positioned to lie in spaced-apart relation to one another and to couple the detachable portion to the fixed portion and the front side wall is formed to include a first inner edge intersecting the first and second tear lines and defining a first finger-receiving opening sized to enable a user to reach therein, grip the detachable portion, and separate the detachable portion from the fixed portion along the first and second tear lines.

6. The container of claim 5, wherein the detachable and fixed portions cooperate to define the first finger-receiving opening therebetween.

7. The container of claim 5, wherein the third frangible connector further includes a third tear line positioned to couple the detachable portion to the fixed portion, the front side wall is also formed to include a second inner edge intersecting the second and third tear lines and defining a second finger-receiving opening sized to enable a user to reach therein, grip the detachable portion, and separate the detachable portion from the fixed portion along the second and third tear lines, and the second tear line is positioned to lie between the first and second finger-receiving openings.

8. The container of claim 2, wherein the fixed portion is rectangle-shaped and is coupled to the left and right end walls, the detachable portion is rectangle-shaped and coupled to the left and right end walls, and the third frangible connector includes a first tear line coupling the detachable portion to the left end wall, a second tear line extending from the left end wall to the right end wall to couple a bottom edge of the detachable portion to an upper edge of the fixed portion, and a third tear line coupling the detachable portion to the right end wall.

9. The container of claim 8, wherein the front side wall is formed to include a pull tab lying along the second tear line and the third frangible connector includes a tear tape strip adhered to the front side wall to extend along the second tear line and coupled to the pull tab.

10. The container of claim 8, wherein the front side wall is formed to include left and right pull tabs lying along the second tear line, the third frangible connector includes a first tear tape strip coupled to the left pull tab and adhered to the front side wall to extend along the second tear line from the first tear line to the left pull tab and a second tear tape strip coupled to the right pull tab and adhered to the front side wall to extend along the second tear line from the right pull tab to the third tear line.

11. The container of claim 2, wherein the front side wall is formed to include a pull tab and the third frangible connector includes a tear tape strip adhered to the front side wall and coupled to the pull tab.

12. The container of claim 11, wherein the third frangible connector further includes one tear line coupling the detachable portion to the left end wall and intersecting the tear tape strip and another tear line coupling the detachable portion to the right end wall and intersecting the tear tape strip.

13. A container comprising a body including a floor and a skirt coupled to the floor and arranged to define a goods-storage region above the floor, the skirt including a rear side wall coupled to the floor and left and right end walls coupled to the floor and arranged to lie in spaced-apart relation to position the rear side wall therebetween, and a convertible section pivotably coupled to the rear side wall for movement between a closure position coupled to the left and right end walls to cover the goods-storage region and a display position uncoupled from the left and right end walls and arranged to uncover the goods-storage region the convertible section including a top wall portion pivotably coupled to the rear side wall a first frangible connector coupling the top wall portion to the left end wall, a second frangible connector coupling the top wall portion to the right end wall, a detachable portion pivotably coupled to the top wall portion, and a third frangible connector coupling the detachable portion to the skirt wherein the top wall portion includes a rear top flap pivotably coupled to the rear side wall, a front top flap pivotably coupled to the detachable portion, a left top flap coupled to the left end wall by the first frangible connector and coupled to each of the rear and front top flaps to permit movement of the front top flap relative to the rear top flap, and a right top flap coupled to the right end wall by the second frangible connector and coupled to each of the rear and front top flaps to permit movement of the front top flap relative to the rear top flap.

14. The container of claim 13, wherein advertising material is applied to at least one of the front top flap and the detachable portion to convey information to observers upon movement of the convertible section to the display position.

15. The container of claim 13, wherein the rear top flap is aligned in coplanar relation to the rear side wall and the front top flap and the detachable portion are aligned in coplanar relation and adjacent to the rear side wall upon movement of the convertible section to the display position.

16. The container of claim 15, wherein advertising material is applied to at least one of the front top flap and the detachable portion to convey information to observers upon movement of the convertible section to the display position.

17. The container of claim 15, wherein the rear top flap and the front top flap are arranged to lie in spaced-apart parallel relation to one another upon movement of the convertible section to the display position.

18. The container of claim 13, wherein the rear top flap and the front top flap are arranged to lie in spaced-apart parallel relation to one another upon movement of the convertible section to the display position, the front top flap includes an inner surface coupled to at least one of the left and right top flaps and an opposite outer surface arranged to lie in perpendicular relation to the floor upon movement of the convertible section to the display position, and advertising material is applied to the outer surface of the front top flap so that it faces away from the rear side wall and toward the goods-storage region upon movement of the convertible section to the display position.

19. The container of claim 18, wherein the rear top flap is aligned in coplanar relation to the rear side wall and the front top flap and the detachable portion are aligned in coplanar relation and adjacent to the rear side wall upon movement of the convertible section to the display position.

20. The container of claim 18, wherein at least one of the left and right top flaps includes a rearward section coupled to the rear top flap, a forward section coupled to the forward top flap, and a fold line between the rearward and forward sections, and the at least one of the left and right top flaps is folded about the fold line upon movement of the convertible section to the display position to cause the rearward section and the forward section to lie in back-to-back relation to one another.

21. The container of claim 13, wherein the left end wall is formed to include a left pull tab and the first frangible connector includes a first tear strip adhered to the left end wall and coupled to the left pull tab.

22. The container of claim 21, wherein the right end wall is formed to include a right pull tab and the second frangible connector includes a second tear strip adhered to the right end wall and coupled to the right pull tab.

23. A container comprising a body including a floor, a front side wall appended to the floor, a rear side wall appended to the floor to lie opposite to the front side wall, and left and right end walls appended to the floor and positioned to lie between the front and rear side walls, and a top wall portion pivotably coupled to the rear side wall for movement between a closure position lying in spaced-apart parallel relation to the floor and a display position lying in perpendicular relation to the floor, the top wall portion includes a rearward top flap pivotably coupled to the rear side wall, a left top flap coupled to the left end wall and having a fold line thus across a forward top flap disconnected from the rearward top flap, and conversion means for using the left flap folded along its fold line to support the forward top flap in coplanar relation to the rearward top flap upon movement of the top wall portion to the closure position and in parallel relation to the rearward top flap upon movement of the top wall portion to the display position without coupling the forward top flap to the rearward top flap so that advertising material provided on an outer surface of the forward top flap faces away from the floor when the top wall portion occupies the closure position and away from the rear side wall and toward the front side wall when the top wall portion occupies the display position.

24. A container comprising a body including a floor, a front side wall appended to the floor a rear side wall appended to the floor to lie opposite to the front side wall and left and right end walls appended to the floor and positioned to lie between the front and rear side walls, and a top wall portion pivotably coupled to the rear side wall for movement between a closure position lying in spaced-apart parallel relation to the floor and a display position lying in perpendicular relation to the floor the top wall portion includes a rearward top flap pivotably coupled to the rear side wall a forward top flap and conversion means for supporting the forward top flap in coplanar relation to the rearward top flap upon movement of the top wall portion to the closure position and in parallel relation to the rearward top flap upon movement of the top wall portion to the display position so that advertising material provided on an outer surface of the forward top flap faces away from the floor when the top wall portion occupies the closure position and away from the rear side wall and toward the front side wall when the top wall portion occupies the display position, wherein the conversion means includes a left top flap, a first frangible connector configured to couple the left top flap to the left end wall when the top wall portion lies in the closure position, a right top flap, a second frangible connector configured to couple the right top flap to the right end wall when the top wall portion lies in the closure position, the rear top flap is coupled to the left and right top flaps, and the front top flap is coupled to the left and right top flaps.

25. The container of claim 24, wherein at least one of the left and right top flaps includes a rearward section coupled to the rear top flap, a forward section coupled to the forward top flap, and a fold line between the rearward and forward sections, and the at least one of the left and right top flaps is folded about the fold line upon movement of the top wall portion to the display position to cause the rearward and forward sections to lie in back-to-back relation to one another and in a space between the rearward and forward top flaps.

26. The container of claim 24, wherein each of the left and right top flaps includes a rearward section coupled to the rear top flap, a forward section coupled to the forward top flap, and a fold line between the rearward and forward sections, and each of the left and right top flaps is folded about one of the fold lines upon movement of the top wall portion to the display position to cause the rearward and forward sections of the left top flap to lie in back-to-back relation to one another and the rearward and forward sections of the right top flap to lie in back-to-back relation to one another.

27. The container of claim 24, wherein the left end wall is formed to include a left pull tab and the first frangible connector includes a first tear strip adhered to the left end wall and coupled to the left pull tab.

28. The container of claim 27, wherein the right end wall is formed to include a right pull tab and the second frangible connector includes a second tear strip adhered to the right end wall and coupled to the right pull tab.

29. The container of claim 24, wherein the right end wall is formed to include a right pull tab and the second frangible connector includes a second tear strip adhered to the right end wall and coupled to the right pull tab.

30. The container of claim 23, wherein the front side wall includes a fixed portion coupled to the floor, a detachable portion coupled to the forward top flap, and a third frangible connector configured to couple the detachable portion to the fixed portion when the top wall portion lies in the closure position.

31. The container of claim 30, wherein the fixed portion is U-shaped and has a first outer edge coupled to the right end wall, a second outer edge coupled to the left end wall, and a third outer edge coupled to the floor.

32. The container of claim 31, wherein the fixed portion includes a first border panel including the first outer edge, a second border panel including the second outer edge, and a bottom border panel interconnecting the first and second border panel and including the third outer edge, the first, second, and bottom border panels cooperate to define a rectangular opening, the detachable portion is positioned to lie in the rectangular opening, and the third frangible connector couples the detachable portion to each of the first, second, and bottom border panels to retain the detachable portion in the rectangular opening defined by the fixed portion until the convertible section is moved to the display position.

33. The container of claim 30, wherein the third frangible connector includes first and second tear lines positioned to lie in spaced-apart relation to one another and to couple the detachable portion to the fixed portion and the front side wall is formed to include a first inner edge intersecting the first and second tear lines and defining a first finger-receiving opening sized to enable a user to reach therein, grip the detachable portion, and separate the detachable portion from the fixed portion along the first and second tear lines.

34. The container of claim 33, wherein the third frangible connector further includes a third tear line positioned to couple the detachable portion to the fixed portion, the front side wall is also formed to include a second inner edge intersecting the second and third tear lines and defining a second finger-receiving opening sized to enable a user to reach therein, grip the detachable portion, and separate the detachable portion from the fixed portion along the second and third tear lines, and the second tear line is positioned to lie between the first and second finger-receiving openings.

35. The container of claim 30, wherein the fixed portion is rectangle-shaped and is coupled to the left and right end walls, the detachable portion is rectangle-shaped and coupled to the left and right end walls, and the third frangible connector includes a first tear line coupling the detachable portion to the left end wall, a second tear line extending from the left end wall to the right end wall to couple a bottom edge of the detachable portion to an upper edge of the fixed portion, and a third tear line coupling the detachable portion to the right end wall.

36. The container of claim 35, wherein the front side wall is formed to include a pull tab lying along the second tear line and the third frangible connector includes a tear tape strip adhered to the front side wall to extend along the second tear line and coupled to the pull tab.

37. The container of claim 35, wherein the front side wall is formed to include left and right pull tabs lying along the second tear line, the third frangible connector includes a first tear tape strip coupled to the left pull tab and adhered to the front side wall to extend along the second tear line from the first tear line to the left pull tab and a second tear tape strip coupled to the right pull tab and adhered to the front side wall to extend along the second tear line from the right pull tab to the third tear line.

38. The container of claim 30, wherein the front side wall is formed to include a pull tab and the third frangible connector includes a tear tape strip adhered to the front side wall and coupled to the pull tab.

39. The container of claim 38, wherein the third frangible connector further includes one tear line coupling the detachable portion to the left end wall and intersecting the tear tape strip and another tear line coupling the detachable portion to the right end wall and intersecting the tear tape strip.

40. The container of claim 30, wherein the advertising material is applied to at least one of the front top flap and the detachable portion to convey information to observers upon movement of the convertible section to the display position.

41. The container of claim 30, wherein the rear top flap is aligned in coplanar relation to the rear side wall and the front top flap and the detachable portion are aligned in coplanar relation and adjacent to the rear side wall upon movement of the top wall portion to the display position.

42. The container of claim 41, wherein the advertising material is applied to at least one of the front top flap and the detachable portion to convey information to observers upon movement of the top wall portion to the display position.

43. A container comprising a body including a floor, a front side wall appended to the floor, a rear side wall appended to the floor to lie opposite to the front side wall, and left and right end panels appended to the floor and positioned to lie between the front and rear side walls, the front side wall includes a fixed portion coupled to the floor and a detachable portion coupled to the fixed portion, and a multi-part top wall portion coupled to the rear side wall, to the detachable portion of the front side wall, and to the left and right end walls, the multi-part top wall portion including a rear top flap coupled to the rear side wall a front top flap coupled to the detachable portion and separated from the rear top wall, a left top flap coupled to the rear and front top flaps and to the left end panel and a right top flap coupled to the rear and front top flaps and to the right end panel the top wall portion and the detachable portion of the front side wall cooperating to define a display header movable relative to the rear side wall between a closed position wherein the top wall portion is coupled to the left and right end walls to lie in spaced-apart parallel relation to the floor and the detachable and fixed portions of the front side wall are positioned to lie in perpendicular relation to the top wall portion and an opened position wherein the top wall portion is uncoupled from the left and right end walls and positioned to lie in perpendicular relation to the floor and the detachable portion of the front side wall is positioned to lie in spaced-apart parallel relation to the fixed portion of the front side wall.

44. A container comprising a body including a floor and a skirt coupled to the floor and arranged to define a goods-storage region above the floor, the skirt including a rear side wall coupled to the floor and left and right end walls coupled to the floor and arranged to lie in spaced-apart relation to position the rear side wall therebetween, and a convertible section pivotably coupled to the rear side wall for movement between a closure position coupled to the left and right end walls to cover the goods-storage region and a display position uncoupled from the left and right end walls and arranged to uncover the goods-storage region, the convertible section including a top wall portion pivotably coupled to the rear side wall, a first frangible connector coupling the top wall portion to the left end wall, a second frangible connector coupling the top wall portion to the right end wall, a detachable portion pivotably coupled to the top wall portion, and a third frangible connector coupling the detachable portion to the skirt, the top wall portion includes a support panel coupled to a top edge of the rear side wall and a display panel coupled to and spaced from the support panel at a fold line arranged to lie in spaced-apart parallel relation to the top edge of the rear side wall and coupled to the detachable portion, the display panel being configured to cause a lower portion thereof to lie between the floor and the top edge of the rear side wall, a middle portion thereof to lie between the top edge of the rear side wall and the fold line of the top wall portion, and an upper portion thereof to lie above the fold line of the top wall portion upon movement of the convertible section to the display position.

45. The container of claim 44, wherein the support panel includes a rear top flap pivotably coupled to the top edge of the rear side wall, a rear portion of a left top flap coupled to the left end wall by the first frangible connector and coupled to the rear top flap, and a rear portion of a right top flap coupled to the right end wall by the second frangible connector and coupled to the rear top flap, and the display panel includes a front top flap pivotably coupled to the detachable portion and disconnected from the rear top flap and formed to include the middle and upper portions of the display panel.

46. The container of claim 45, wherein the display panel further includes a front portion of the left top flap coupled to the left end wall by the first frangible connector and coupled to a left side of the middle portion of the front top flap and a front portion of the right top flap coupled to the right end wall by the second frangible connector and coupled to a right side of the middle portion of the front top flap.

47. The container of claim 2, wherein the top wall portion further includes a left top flap coupled to the left end wall by the first frangible connector and to each of the rear and front top flaps and a right top flap coupled to the right end wall by the second frangible connector and to each of the rear and front top flaps.

* * * * *